US005263709A

United States Patent [19]

Tseng

[11] Patent Number: 5,263,709

[45] Date of Patent: Nov. 23, 1993

[54] RACKET WITH IMPROVED DIMENSIONAL STABILITY

[76] Inventor: Kuni Tseng, 6F-1, No. 342, Keelung Road, Sec. 1, Taipei, Taiwan

[21] Appl. No.: 998,016

[22] Filed: Dec. 29, 1992

Related U.S. Application Data

[63] Continuation of Ser. No. 918,466, Jul. 22, 1992, abandoned.

[51] Int. Cl.[5] ..... A63B 49/02

[52] U.S. Cl. ..... 273/73 D; 273/73 R

[58] Field of Search ..... 273/73 R, 73 C, 73 D

[56] References Cited

U.S. PATENT DOCUMENTS

| | | | |
|---|---|---|---|
| 1,942,479 | 1/1934 | Kleinman | 273/73 C |
| 3,968,966 | 7/1976 | D'Aquanni | 273/73 D |
| 4,802,678 | 2/1989 | Svoma | 273/73 C X |
| 5,009,422 | 4/1991 | Soong | 273/73 C X |
| 5,037,097 | 8/1991 | Svoma et al. | 273/73 C |

*Primary Examiner*—V. Millin
*Assistant Examiner*—Raleigh W. Chiu
*Attorney, Agent, or Firm*—Pro-Techtor International

[57] ABSTRACT

A racket comprising a head consisting of a frame and a plurality of interwoven strings, the frame is formed with a number of stringing holes which are obliquely passed from the outside of the frame substantially at the center of the thickness thereof through the frame itself to the inside of the frame in alternative different inclined directions with respect to the thickness of the frame, thereby only one row of the openings of the stringing holes is appeared on the outside of the frame along periphery at substantial center line while two rows of the openings of the stringing holes are formed on the inside of the frame along two opposite rims thereof.

1 Claim, 2 Drawing Sheets

RACKET WITH IMPROVED DIMENSIONAL STABILITY

BACKGROUND OF THE INVENTION

This is a continuing application of U.S. patent application Ser. No. 07/918,466, filed Jul. 22, 1992, now abandoned.

Conventionally, a racket comprises a head consisting of a frame and a plurality of interwoven strings. The frame is provided with a number of stringing holes along the periphery thereof, in which the holes are substantially parallel to the plane of the head. In other words, perpendicular to the outer surface of the head, and at its midpoint. A certain distance from the striking surface to the top and bottom edges of the inside of the frame is therefore unavoidable. This causes ineffective striking of the ball if the contact point is near the periphery of the frame.

In order to reduce the distance from the striking surface to the edges of the frame, two rows of stringing holes have been provided in the prior art, one row along the top edge of the frame, and a second row along the bottom edge.

A disadvantage of that arrangement is that a greater torque is applied to the frame during the stringing operation, which impairs the stability of the head of the racket.

SUMMARY OF THE INVENTION

The object of this invention is to provide a racket with improved stability to overcome the drawbacks of the rackets known in the art.

The aforementioned object is accomplished by a racket according to the present invention which provides a special arrangement of the stringing holes in the frame, in which the stringing holes obliquely pass through the frame from the outside to the inside in alternating directions of inclination so that only one row of the stringing holes is formed on the outside edge of the racket, near its centerline, while two rows of stringing holes appear on the inside of the frame along the two edges thereof.

These and other objects and advantages of the present invention will become apparent to those skilled in the ar in view of the description of the best presently known mode of carrying out the invention as described herein and as illustrated in the drawings.

DETAILED DESCRIPTION OF THE PREFERRED EMBODIMENT

Figure 1:
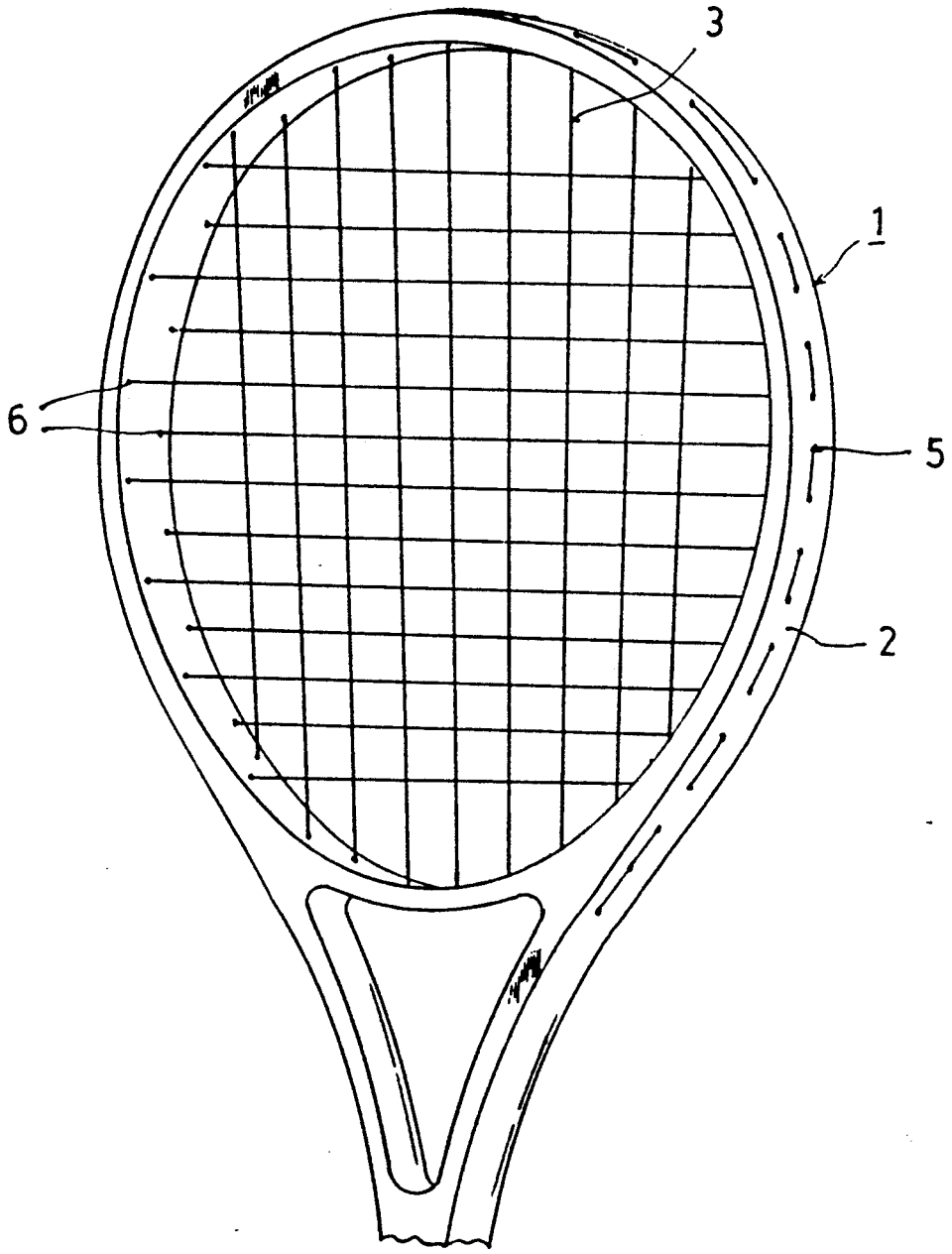
FIG. 1 is a schematic perspective view of the head of the racket according to the present invention.
Figure 2:
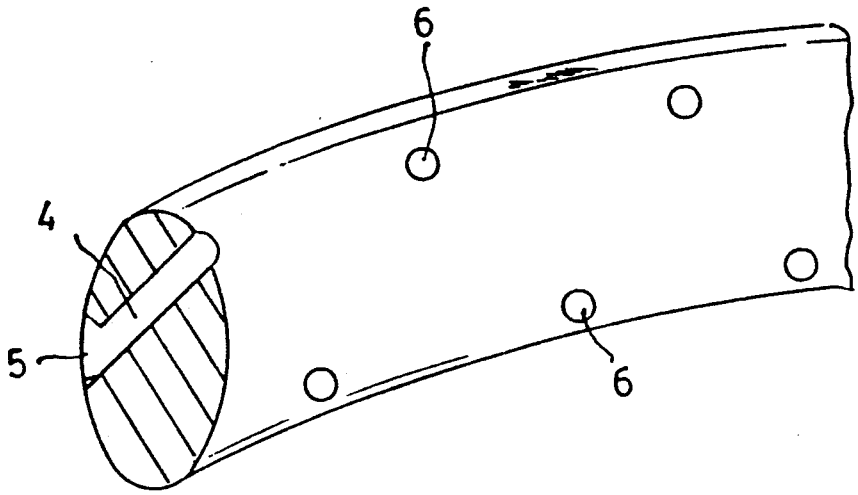
FIG. 2 is a detailed view showing a cross section of the frame.
Figure 3:
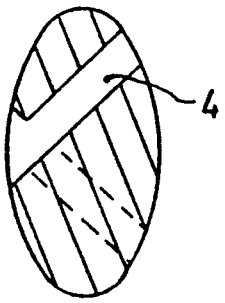
FIG. 3 is a cross section showing the inclined stringing hole of the present invention.

Referring to FIGS. 1–3 of the drawings, the racket comprises a head 1 consisting of a frame 2 and a plurality of interwoven strings 3. Said frame 2 is formed with a number of stringing holes 4 which obliquely pas from the outside of the frame substantially at its midpoint, through the frame 2 itself to the inside of the frame in alternating directions of inclination, as best shown in FIG. 2 and 3. Thus, only one row of holes appears on the outside of the frame at substantially its midpoint, while two rows of the openings 6 of the stringing holes are formed on the inside of the frame along its opposing edges.

It is seen that since the stringing holes are inclined with respect to the thickness of the frame, during the stringing operation of the strings 3, the torque exerted onto the frame is considerably reduced as compared to the case of the stringing holes being arranged along the edges of the frame and perpendicular to the thickness of the frame. As a result, the chance of twisting and breaking the frame is considerably reduced.

While there have been shown and described what are at present considered the preferred embodiments of the present invention, it will be obvious to those skilled in the art that various changes and modifications may be made therein without departing from the scope of the invention as defined by the appended claims.

What I claim is:

1. A racket comprising a head consisting of a frame and a plurality of interwoven strings, said frame being formed with a number of stringing holes which obliquely pass from the outside substantially at the center of said frame through said frame itself to the inside of said frame in alternating directions of inclination with respect to the thickness of said frame, whereby only one row of the stringing holes is formed on the outside substantially at the center of the frame while two rows of the stringing holes are formed on the inside of said frame, one row being near a top edge of the inside of the frame and a second row being near a bottom edge of the inside of the frame.

* * * * *